United States Patent [19]

Ertl

[11] Patent Number: 4,950,093

[45] Date of Patent: Aug. 21, 1990

[54] SUPPORT MECHANISM FOR MULTIPLE-KEY UNITS

[75] Inventor: Wolfgang Ertl, Freihung, Fed. Rep. of Germany

[73] Assignee: Cherry Mikroschalter GmbH, Auerbach, Fed. Rep. of Germany

[21] Appl. No.: 380,373

[22] Filed: Jul. 17, 1989

[30] Foreign Application Priority Data

Jul. 22, 1988 [DE] Fed. Rep. of Germany ..... 3824980

[51] Int. Cl.[5] ..... B41J 5/16

[52] U.S. Cl. ..... 400/496; 400/472

[58] Field of Search ..... 400/496, 495.1, 472, 400/491.2, 473; 200/340, 5 A, 341, 344, 345; 235/145 R

[56] References Cited

U.S. PATENT DOCUMENTS

| | | | |
|---|---|---|---|
| 3,720,801 | 3/1973 | Yanaga | 400/496 X |
| 4,010,838 | 3/1977 | Sims, Jr. | 400/496 |
| 4,384,796 | 5/1983 | Denley | 400/495.1 X |
| 4,453,063 | 6/1984 | Wanatowicz, Jr. | 200/344 |
| 4,468,145 | 8/1984 | Denley | 400/495.1 X |
| 4,535,210 | 8/1985 | Shedore | 200/344 |
| 4,580,022 | 4/1986 | Oelsch | 200/344 |
| 4,771,146 | 9/1988 | Suzuki | 400/496 X |
| 4,830,526 | 3/1989 | Hosono | 400/472 X |

FOREIGN PATENT DOCUMENTS

| | | |
|---|---|---|
| 0304847 | 3/1989 | European Pat. Off. . |
| 2208647 | 9/1973 | Fed. Rep. of Germany . |

OTHER PUBLICATIONS

A copy of the European Search Report.

*Primary Examiner*—Edgar S. Burr
*Assistant Examiner*—M. Patel
*Attorney, Agent, or Firm*—Sandler, Greenblum & Bernstein

[57] ABSTRACT

A multiple-key unit is provided that includes a top portion, a base portion and a support mechanism. The support mechanism is provided with a body portion and a substantially U-shaped wire. The U-shaped wire includes a cross-part and two free ends that are inwardly bent and are parallel to the cross-part of the wire. The cross-part of the U-shaped wire is rotatably supported in a bearing in an eccentric manner at the key top and is parallel to the central, longitudinal axis of the key top. An assembly stop extends from the bearing and maintains the U-shaped wire, during assembly, in an oblique assembly position. Moreover, wire guides are provided in the cross-sides of the key base to vertically receive the free ends of the U-shaped wire during assembly, and in which wire guides the free ends are horizontally displaceable when the key is actuated.

11 Claims, 3 Drawing Sheets

SUPPORT MECHANISM FOR MULTIPLE-KEY UNITS

FIELD OF THE INVENTION

This invention is directed to a support mechanism for multiple-key switch units having a wire bent into a U-shape that is pivotably supported at the top of the key and at both sides of the key as well as at the base of the key. This structure allows plunger actuation of the key device which is essentially free of tipping moments. The free ends of the U-shaped wire, upon depression of the key, are laterally displaced in a rest provided for that purpose.

DISCUSSION OF BACKGROUND AND RELEVANT INFORMATION

In the conventional key switch of the kind mainly used in typing keyboards, the switching action is more responsive the closer the key is loaded at the center, so that it will be above the plunger guide. If there is such actuation on the key center, that is above the plunger guide, no tipping moments will be applied to the guide. In conventional keys, the size of the edges are substantially 1:1 forming a substantially square profile, and for a size of about 18×18 mm, no bothersome tipping moments arise. Furthermore, the finger-trough provided at the top of the key favors central actuation of conventional keys.

However, entirely different behavior upon actuation takes place with so called multiple-key units which are longer in one direction than the other, with the edge ratio on these multiple-key units being larger than 1:1. These multiple-key units are preferred in special operations, for instance, for the new line, shift or space keys. Because the key is longer in one direction, it is no longer centrally actuated, rather, as a rule, it is actuated eccentrically thereby causing tipping moments to the plunger guide.

When such a multiple-key key is depressed at its edge, and mechanical means are not provided below its top, then a higher force of actuation is demanded due to tipping moments caused by the eccentric loading which produces higher friction in the plunger guide. In extreme cases, key operation is no longer reliable, and the key may be pressed out of its mounting at the keyboard.

To overcome such difficulties, it is known to provide multiple-key units with an actuation mechanism consisting of a U-shaped wire connected in movable fashion, directly or indirectly, with the top of the base of the key. The connection locations at the top of the key are located near the outer key edges, with the free ends of the U-shaped wire passing through bore-holes in which they are held in both a tippable and displaceable manner. The bottom section of the wire is rotatably supported at the key base.

When eccentric actuation from the top of the key takes place, force is deflected by the wire which is rotatably supported in the key base and transmitted to the opposite edge of the key top. Thereby, even if the key is actuated eccentrically, the opposite side of the key top is also pulled down by means of a wire, whereby uniform force transmission is achieved and the guide means of the key plunger is free of any significant tipping moments. Thereby problem-free actuation shall always be obtained.

Even though such a supporting mechanism satisfactorily meets its required function, this known solution nevertheless has a serious drawback if the switch assembly and especially the key top are mounted automatically on the key base.

That is because the known U-shaped wire when processed on an automated machine can be threaded only with extreme difficulty into the support mechanism provided at the top of the key, and accordinly heretofore manual assembly has been preferred for the reason of cost and in light of the significant amount of rejects inevitable in the partly automated manufacture. Moreover, such a wire held at the top of the key does not lend itself to being mounted by mechanically pressing the multiple keys onto the key base, and again the need for manual assembly is necessary.

The object of the present invention is to overcome the drawbacks of the prior U-shaped wire, and this object is to change the support mechanism of the tops of multiple-key units so that they may be assembled automatically together with the single keys in one operational step. This drawback is solved in that the free ends of the U-shaped wire are bent inwardly approximately at right angles, and parallel to its crossed part with the cross-part of the wire being rotatably supported in mechanical supports in an eccentric manner at the top of the key and parallel to the longitudinal axis. The U-shaped wire is held in an obliquely assembled position by means of a stop, and the key base includes a wire guide means that can vertically receive the free ends of the U-shaped wire during assembly, with the free ends being horizontally displaceable when the key is actuated.

This design of the support mechanism allows automatic assembly of all key tops, i.e., single key units and multiple-key units, by applying pressure from above to the premounted units.

SUMMARY OF THE INVENTION

It is an object of the present invention to provide a support mechanism for a multiple-key unit that permits actuation of the multiple-key unit even when the multiple-key unit is eccentrically actuated. It is further object of the present invention to provide a support mechanism for a multiple-key unit that permits automatic assembly of all key tops, i.e., both single key units and multiple-key units.

These objects of the present invention are achieved by providing a support mechanism for multiple-key unit tops comprising a substantially U-shaped wire having a cross-part and free ends, which U-shaped wire is rotatably supported both at the top of the key and both sides of a plunger guide and close to the outside edges as well as at the base of the key, with said U-shaped wire allowing a plunger to be actuated in a manner essentially free of tipping moments. The free ends of the U-shaped wire are bent substantially parallel to the cross-part toward the inside, and the cross-part of the substantially U-shaped wire is rotatably supported parallel to a central longitudinal axis at the top of the key and eccentrically in mechanism supports. The U-shaped wire is maintained by an assembly stop in an oblique asesmbly position. Moreover, the key base includes wire guides at its cross-sides, with the free ends of the wire being vertically insertable during assembly into the wire guides and, during actuation of the top of the key, being horizontally displaceable in the wire guides.

The mechanism supports holding the cross-part of the substantially U-shaped wire are equipped with a bearing associated with an assembly stop which extends in an obliquely downward direction, and which keeps the substantially U-shaped wire freely suspended from the top of the key in an oblique position suitable for assembly.

The wire guides at the key base include a vertical wire guide to assist insertion of the wire, a channel bounded by a fixture and a bottom edge of the key base.

Guide ribs are present at the mechanism supports in order to horizontally position the wire when at rest and when operational, relative to the key base and the mechanism supports.

It is a further object of the present invention to provide a support mechanism for a multiple-key unit, which support mechanism includes a body portion and a substantially U-shaped wire. The body portion is provided with means for attaching the body portion to a top portion of the multiple-key unit, bearing means for pivotably holding a U-shaped wire, and means for maintaining the substantially U-shaped wire at an oblique position. Moreover, the substantially U-shaped wire includes a cross-part connected to free ends, with the free ends being inwardly bent and parallel to said cross-part.

The support mechanism may also be provided with means for ensuring horizontal alignment of the substantially U-shaped wire, such as a guide rib. Furthermore, the cross-part of the substantially U-shaped wire can have a length that is substantially equal to that of the body portion.

Additionally, the support mechanism may include protrusions that are capable of attaching the support mechanism to a top portion of a multiple-key unit.

It is still another object of the present invention to provide a key base for a multiple-key unit. This key base may be provided with a base portion having a guide fixing forming a channel for receiving a wire and a guide shoulder spaced from said guide fixture. The base portion may be provided with a bottom edge; and the guide fixture forming said channel may include an inside guide shoulder forming an end portion of said channel, and an elongated leg positioned substantially parallel to the bottom edge forming the width of the channel. Furthermore, the inside guide shoulder and the elongated leg may be attached to each other, and the width of the channel formed by the guide fixture can be dimensioned to be slightly greater than the width of the wire.

It is still another object of the present invention to provide a multiple-key unit comprising a top portion, a base portion and a support mechanism. The top portion of this multiple-key unit may be provided with means for attaching the top portion to the base portion and the support mechanism. The support mechanism may be provided with a body portion and a substantiallyt U-shaped wire. The body portion may include means for attaching the body portion to the top portion; bearing means for pivotably holding a U-shaped wire; and means for maintaining the substantially U-shaped wire at an oblique position during assembly. The substantially U-shaped wire may include a cross-part connected to free ends, with the free ends being inwardly bent and parallel to the cross-part. The base portion may include a guide fixture forming a channel for receiving the free ends of the substantially U-shaped wire, and a guide shoulder spaced from the guide fixture, whereby the free ends of the substantially U-shaped wire are substantially horizontally displaceable in the guide fixture during actuation of the multiple-key unit.

Furthermore, the multiple-key unit may include various elements, such as those discused above for the support mechanism and key base.

The advantages and features of the invention are set forth below in relation to an illustrated embodiment together with the claims and drawings.

DESCRIPTION OF THE PREFERRED EMBODIMENTS

Figure 1:
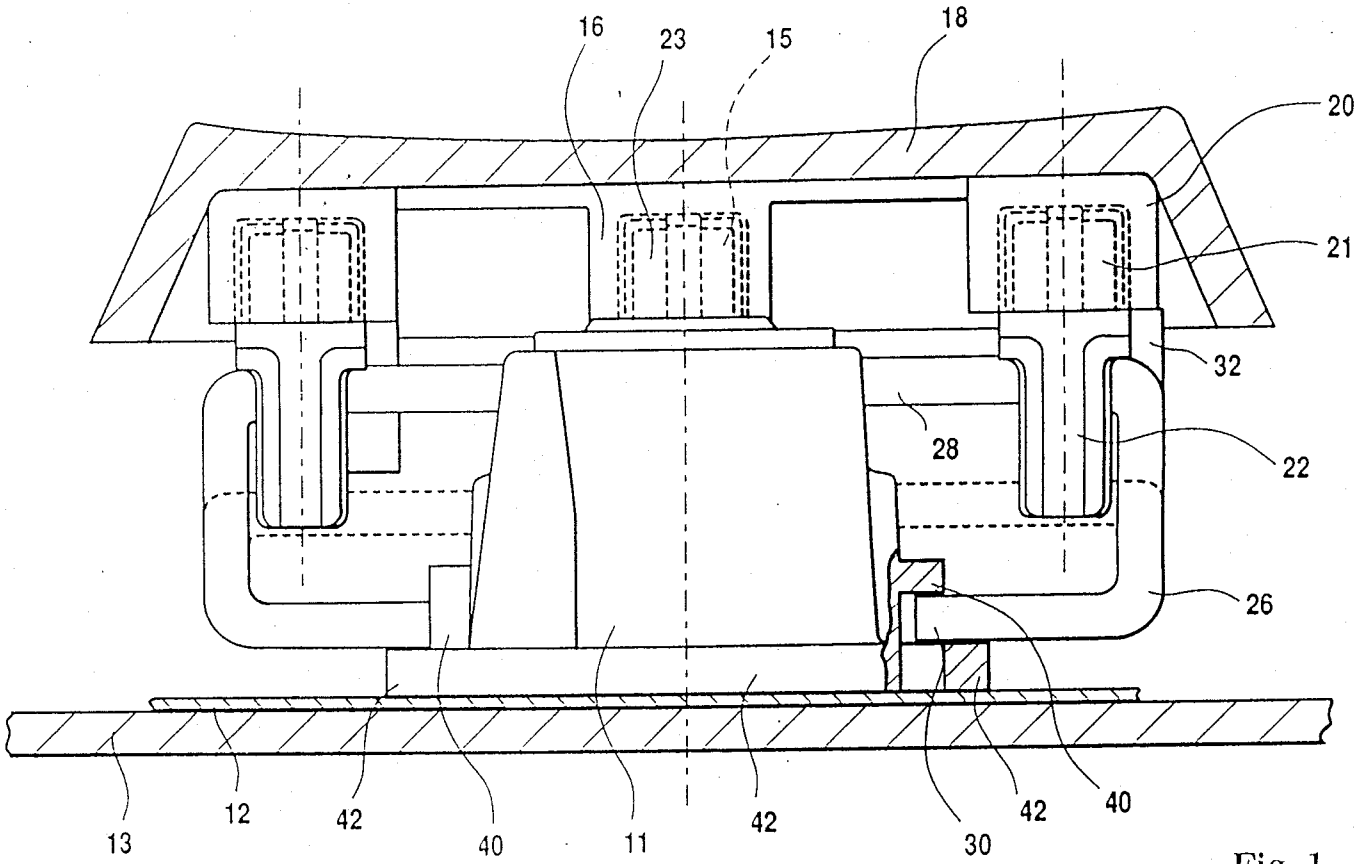
FIG. 1 is a rear view of a multiple-key unit with a support mechanism according to the present invention.

The multiple-key unit shown in the figures is used for a foil keyboard, wherein the key base 11 is mounted directly on a foil 12 by riveting to a sheet metal support 13 underneath the foil.

Inside the key base 11 there is a conventional contact means actuated by plunger 15 and a top 18 attached to the latter.

The plunger 15 is inserted into a socket 16 at the underside of the top 18 of the key, with this socket 16 being centrally located with respect to the width and length of the multiple-key top unit.

On both sides of the socket, that is, near the outer edges of the multiple-key top 18, further sockets 20 are provided and into each of these sockets is inserted a protrusion 21 of support mechanism 22.

Figure 2:
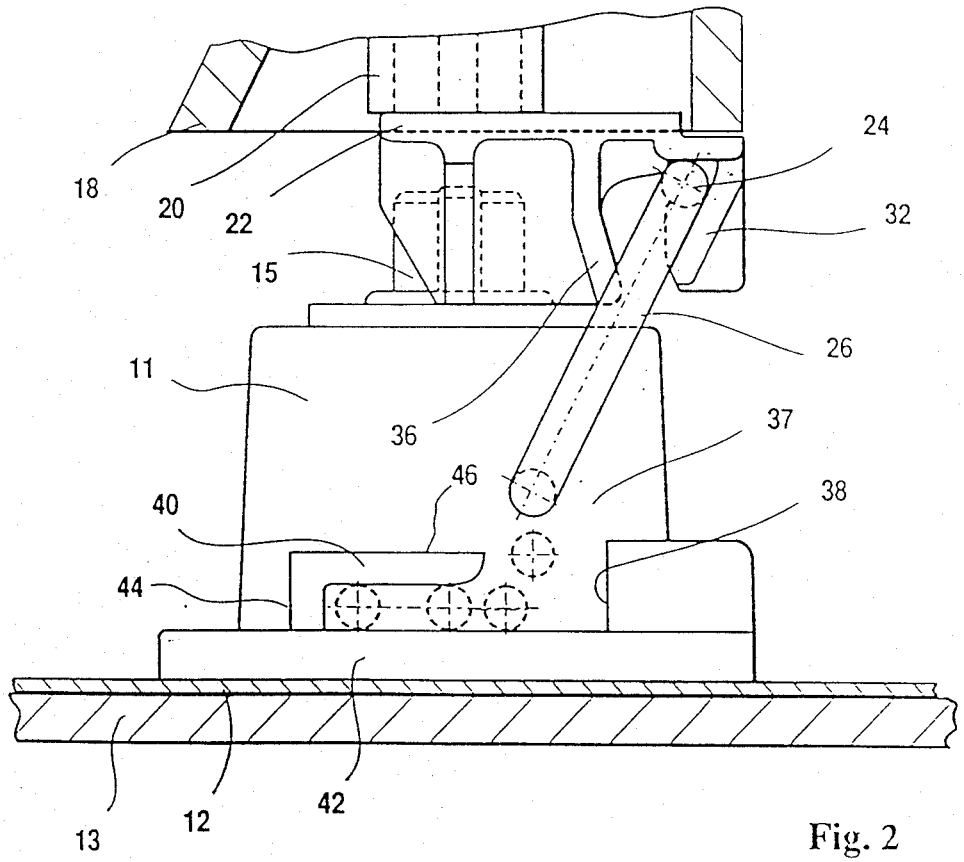
FIG. 2 is a side view of a multiple-key unit in a first position when a key top is being deposited.
Figure 3:
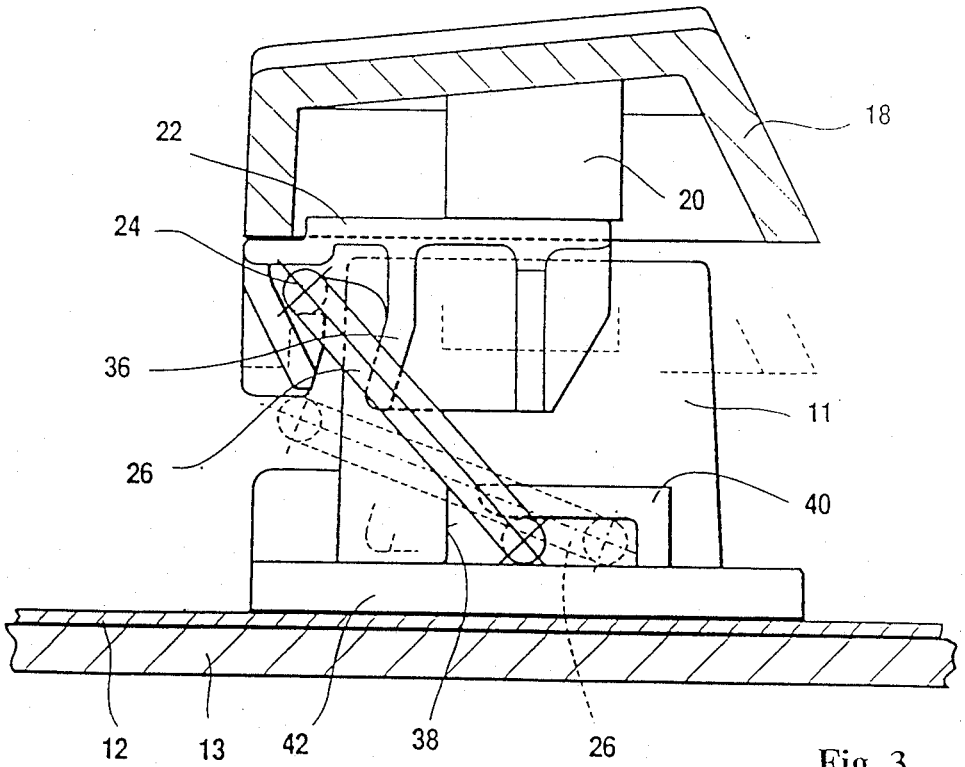
FIG. 3 is a side view of the multiple-key unit with the deposited key top.

Such a support mechanism 22 is shown in the side view in FIGS. 2 and 3, making a plane that includes a bearing 24 that is designed as a snap-in bearing and serving to receive a wire 26.

The drawing further illlustrates that this wire 26 is bent into a U-shape which has a wide cross-part 28 which is provided and extends over approximately the entire length of the multiple-key top and which can snap into position by means of sections as far out as possible into the bearing 24 in the support mechanism 22.

The free ends 30 of the wire are bent inwardly whereby they are made parallel to the cross-part 28 and they terminate in a plane located somewhat outside the outer boundary plane of the key base 11.

The support mechanism 22 extends as far as the middle zone of the multiple-key unit top and comprises an outwardly projecting protrusing 23 which can be inserted into the plug-in sleeve 16. An assembly stop 32 extending at a downward slant is present outside the bearing 24, whereby the wire 26 having its cross-part inserted into the bearing 24 is kept obliquely suspended in such a manner, as will be discussed below, that the free ends of the wire shall be fixed in the appropriate assembly position when the multiple key unit top 18 is deposited on the key base 11. The support mechanism 22 further comprises a guide rib 36 along the inside of the bent wire 26 that ensures horizontal alignment of the wire 26 when the key is actuated.

A guide fixture 40 for the free end 30 of the wire is provided as a wire guide means 37 at the cross-sides of the key base 11 shown in FIGS. 1 and 2. A guide shoulder 38 extends a horizontal distance from the guide fixture 40 that is substantially equal to or greater than twice the diameter of the wire 26. The guide fixture 40 consists of an L-shaped channel projecting beyond the cross-side of the key base, the longer leg 46 of this channel being parallel to foil sheet 12, i.e., parallel to the bottom edge 42 of the key base. As a result a cross-wise clearance is present, the inside guide shoulder 44 of the guide fixture 40 being a distance away from the bottom edge by somewhat more than the diameter of the free end 30 of the wire 26.

Such a guide fixture is mounted on both cross-sides of the key base.

To assemble the key board, the individual key bases are deposited on the foil sheet and riveted to the sheet metal support.

In order to deposit the top of the keys, these tops together with all premounted parts are placed on a pallet and are set up, the wires positioned in the multiple-key top units drop on account of their weight and come to rest against the assembly stops 32, whereby the wires 26 assume the position required for automatic assembly. The key tops are displaced further down while in that position, whereby the free ends 30 of the wires 26 are moved downwardly between the guide shoulder 38 and the guide fixture 40 as far as the bottom edge 42 against which ultimately they come to rest. This position is shown by solid lines in FIG. 3, and represents the position of the fully assembled key top.

When the multiple-key unit top is actuated, it will be depressed whereby the free ends 30 of the wire 26 are laterally displaced between the guide fixture 40 and the bottom edge 42 in the manner shown by the dash lines in FIG. 3. Because the inside of the wires rest against the guide ribs 36 in a loose manner, horizontal alignment also is assured.

If a multiple-key unit top so mounted is eccentrically actuated, the wire assures that the force is also transmitted to the other end of said top. Accordingly, bilateral transmission of the actuation force is assured and tipping moments are prevented. It will, therefore be apparent, that the multiple-key units, i.e., keys that have side edges that are not of equal lengths, including the support mechanism according to the present invention do not suffer from tipping moments when actuated. Accordingly, the wire which forms part of the support mechanism of the instant invention not only reduces the tipping moments of multiple-key units, but reduces the need for manual assembly of the multiple-key unit during manufacture.

Although the invention has been described with reference to particular means, materials and embodiments, it is to be understood that the invention is not limited to the particulars disclosed, and extends to all equivalents within the scope of the claims.

The invention claimed is:

1. A multiple-key unit comprising a top portion, a base portion and a support mechanism;

said top portion including means for attaching said top portion to said base portion and said support mechanism;

said support mechanism comprising a body portion and a substantially U-shaped wire;

said body portion including means for attaching said body portion to said top portion; bearing means for pivotably holding said substantially U-shaped wire; and means for maintaining said substantially U-shaped wire at an oblique position during assembly; and said substantially U-shaped wire including two free ends and a cross-part connected to said free ends, said free ends being inwardly bent and parallel to said cross-part; and said base portion including a guide fixture forming a channel for receiving said free ends of said substantially U-shaped wire, and a guide shoulder spaced from said guide fixture by a distance substantially greater than the diameter of said wire, whereby said free ends of said substantially U-shaped wire are substantially horizontally displaceable in said guide fixture during actuation of the multiple-key unit.

2. The multiple-key unit according to claim 1, wherein said support mechanism further includes means for ensuring horizontal alignment of said substantially U-shaped wire.

3. The multiple-key wire according to claim 1, wherein said cross-part of said substantially U-shaped wire has a length that is substantially equal to that of said body portion.

4. The multiple-key unit according to claim 2, wherein said cross-part of said substantially U-shaped wire has a length that is substantially equal to that of the body portion.

5. The multiple-key unit according to claim 4, wherein said means for ensuring horizontal alignment of said substantially U-shaped wire comprises a guide rib.

6. The multiple-key unit according to claim 1, wherein said means in the top portion for attaching said support mechanism include sockets, and said support mechanism includes protrusions that are adapted to fit into said sockets.

7. The multiple-key unit according to claim 1, wherein said base portion includes a bottom edge; and said guide fixture forming said channel includes an inside guide shoulder forming an end portion of said channel, and an elongated leg positioned substantially parallel to said bottom edge forming the width of said channel.

8. The multiple-key unit according to claim 7, wherein said inside guide shoulder and said elongated leg are attached to each other, and the width of the channel formed by said guide fixture is slightly greater than the width of the wire.

9. The multiple key unit according to claim 5, wherein said guide rib extends from said body portion.

10. The multiple-key unit according to claim 1, wherein said means for maintaining said substantially U-shaped wire at an oblique position comprises at least one assembly stop extending from said body portion.

11. A multiple-key unit comprising a top portion, a base portion and a support mechanism;

said top portion including mean for attaching said top portion to said base portion and said support mechanism;

said support mechanism comprising a body portion and a substantially U-shaped wire;

said body portion including means for attaching said body portion to said top portion; bearing means for pivotably holding said substantially U-shaped wire; and means for maintaining said substantially U-shaped wire at an oblique position during assembly;

said substantially U-shaped wire including two free ends and a cross-part connected to said free ends, said free ends being inwardly bent and parallel to said cross-part;

said base portion including a guide fixture forming a channel for receiving said free ends of said substantially U-shaped wire, and a guide shoulder spaced from said guide fixture, wherein said free ends of said substantially U-shaped wire are substantially horizontally displaceable in said guide fixture during actuation of the multiple-key unit; and a guide rib extending from said body portion to ensure horizontal alignment of said substantially U-shaped wire.

* * * * *